United States Patent [19]

Imagawa

[11] Patent Number: 5,072,642

[45] Date of Patent: Dec. 17, 1991

[54] REINFORCED SOUND BOARD USED IN MUSICAL INSTRUMENT

[75] Inventor: Katsuhiko Imagawa, Shizuoka, Japan

[73] Assignee: Yamaha Corporation, Hamamatsu, Japan

[21] Appl. No.: 556,422

[22] Filed: Jul. 24, 1990

[30] Foreign Application Priority Data

Jul. 28, 1989 [JP] Japan ..... 1-196017

[51] Int. Cl.[5] ..... B10C 3/06

[52] U.S. Cl. ..... 84/193

[58] Field of Search ..... 84/174, 192, 193, 184, 84/275, 452 R

[56] References Cited

U.S. PATENT DOCUMENTS 4,348,933 9/1982 Kaman et al. ..... 84/193

FOREIGN PATENT DOCUMENTS 57-136693 8/1982 Japan .

*Primary Examiner*—Hix, L. T.
*Assistant Examiner*—Howard B. Blankenship
*Attorney, Agent, or Firm*—Burns, Doane, Swecker & Mathis

[57] ABSTRACT

A sound board incorporated in a musical instrument such as, for example, a piano or a string instrument comprises a wooden plate member containing wood fibers substantially oriented to a first direction, and a plurality of thread members fixed to at least one major surface of the wooden plate member at spacings and extending in directions substantially parallel to the first direction, in which the wooden plate member has a first modulus of longitudinal elasticity to a force exerted thereto in a direction substantially parallel to the first direction and in which each of the thread members has a second modulus of longitudinal elasticity larger than the first modulus of longitudinal elasticity so that the sound board is reinforced against a force in the direction substantially parallel to the first direction only, thereby allowing the sound board to produce a soft deep sound.

15 Claims, 3 Drawing Sheets

REINFORCED SOUND BOARD USED IN MUSICAL INSTRUMENT

FIELD OF THE INVENTION

This invention relates to a musical instrument such as, for example, a piano, an organ, a guitar or a violin and, more particularly, to a sound board forming part of a case or a resonator of the musical instrument by way of example.

DESCRIPTION OF THE RELATED ART

In general, a resonator is incorporated in a musical instrument, and a sound board forms a part of the resonator. When a sound source such as a string vibrates, the vibrations to be produced are converted into an acoustic energy by the sound board and increased in amplitude by the resonator. A particular tone-color is imparted to the sound depending upon the sound board. In fact, the material of the sound boards strongly affects the tone color to be imparted to the sound, and, for this reason, a craftsman carefully selects the material and designs a musical instrument.

A soft sound is usually desirable for various acoustic musical instruments and is produced by attenuating the higher order harmonic tones of a sound. The sound board of wood is expected to attenuate the higher order harmonic tones of a sound to be produced, and, for this reason, a wooden plate of spruce or maple tree is widely used for the sound board. If a sound board has a large ratio of the modulus of longitudinal elasticity El to a force exerted to the sound board in a direction parallel to wood fibers to the modulus of traverse elasticity G, vibrations supplied to the sound board is converted to an acoustic energy for producing a sound, and the higher order harmonic tones of the sound are attenuated in radiating the sound so as to make the sound soft. The words "direction parallel to wood fibers" are similar in concept to "wood grains direction". Moreover, a large ratio of the modulus of longitudinal elasticity El to the specific gravity also softens the sound. As a result, it is desirable for the sound board to have a large ratio of the modulus of longitudinal elasticity El to the modulus of traverse elasticity G as well as a large ratio of the modulus of longitudinal elasticity El to the specific gravity.

However, a natural wooden plate is not so large in the modulus of longitudinal elasticity El to a force exerted in a direction parallel to the wood fibers that the sound to be produced hardly satisfies a professional class in view of the tone color.

A solution is provided in Japanese Patent Application Laid-open (Kokai) No. 57-136693, and the sound board disclosed therein consists of a wooden plate and a sheet member of a carbon fiber reinforced plastic substance (often abbreviated as "CFRP") bonded to one another.

However, the sheet member of the carbon fiber reinforced plastic substance increases not only the modulus of longitudinal elasticity El to a force exerted in a direction parallel to the wood fibers but also the modulus of longitudinal elasticity ER to a force exerted to a direction perpendicular to the wood fibers. The sound board thus reinforced can produce a large sound but is less effective to softening of the sound. Thus, a problem is encountered in the sound board proposed in Japanese Patent Application Laid-open No. 57-136693 in production of a soft sound.

SUMMARY OF THE INVENTION

It is therefore an important object of the present invention to provide a sound board which produces a soft deep sound.

It is also an important object of the present invention to provide a musical instrument which has a sound board for producing a soft deep sound.

To accomplish these objects, the present invention proposes to reinforce a wooden plate member with thread members provided in parallel to a major direction of wood fibers.

In accordance with one aspect of the present invention, there is provided a sound board incorporated in a musical instrument comprising a) a wooden plate member containing wood fibers substantially oriented to a first direction, the wooden plate member having a first modulus of longitudinal elasticity to a force exerted thereto in a direction substantially parallel to the first direction, and b) a plurality of thread members fixed to at least one major surface of the wooden plate member at spacings and extending in directions substantially parallel to the first direction, each of the thread members having a second modulus of longitudinal elasticity larger than the first modulus of longitudinal elasticity.

The sound board thus fabricated is not increased in an equivalent modulus of traverse elasticity but is reinforced against a force exerted thereon in the first direction. This results in that the sound board has a large ratio of an equivalent modulus of longitudinal elasticity to a force in the first direction to the equivalent modulus of traverse elasticity. The large ratio allows the sound board to attenuate higher order harmonic tones of a sound to be produced, and, therefore, the sound is softened.

Moreover, if each of the thread members has a ratio of the second modulus of longitudinal elasticity to a second specific gravity thereof larger than a ratio of the first modulus of longitudinal elasticity to a first specific gravity of the wooden plate member, the thread members increase a ratio of the equivalent modulus of longitudinal elasticity to an equivalent specific gravity of the sound board. Thus, the sound board is incremented in the ratio of the equivalent modulus of longitudinal elasticity to the equivalent specific gravity by the thread members, and the increment of the ratio is conducive to producing a large sound with sufficient spread.

In accordance with another aspect of the present invention, there is provided a grand piano comprising a) a frame supported by legs, b) a sound board provided on the frame, c) a plurality of strings stretched over the sound board, d) a key board having a plurality of keys and provided on a key bed which in turn is supported by the legs, and e) a key action mechanism provided in association with the key board and operative to cause hammer members to selectively strike the strings in accordance with motions of the keys, in which the sound board comprises b-1) a wooden plate member containing wood fibers substantially oriented to a first direction, the wooden plate member having a first modulus of longitudinal elasticity to a force exerted thereto in a direction substantially parallel to the first direction, and b-2) a plurality of thread members fixed to at least one major surface of the wooden plate member at spacings and extending in directions substantially parallel to the first direction, each of the thread members having a second modulus of longitudinal elasticity larger than the first modulus of longitudinal elasticity.

BRIEF DESCRIPTION OF THE DRAWINGS

The features and advantages of a sound plate and an musical instrument equipped with the sound board according to the present invention will be more clearly understood from the following description taken in conjunction with the accompanying drawings in which.

DESCRIPTION OF THE PREFERRED EMBODIMENTS

Description is briefly made on musical instruments to which the present invention appertains.

Figure 1:
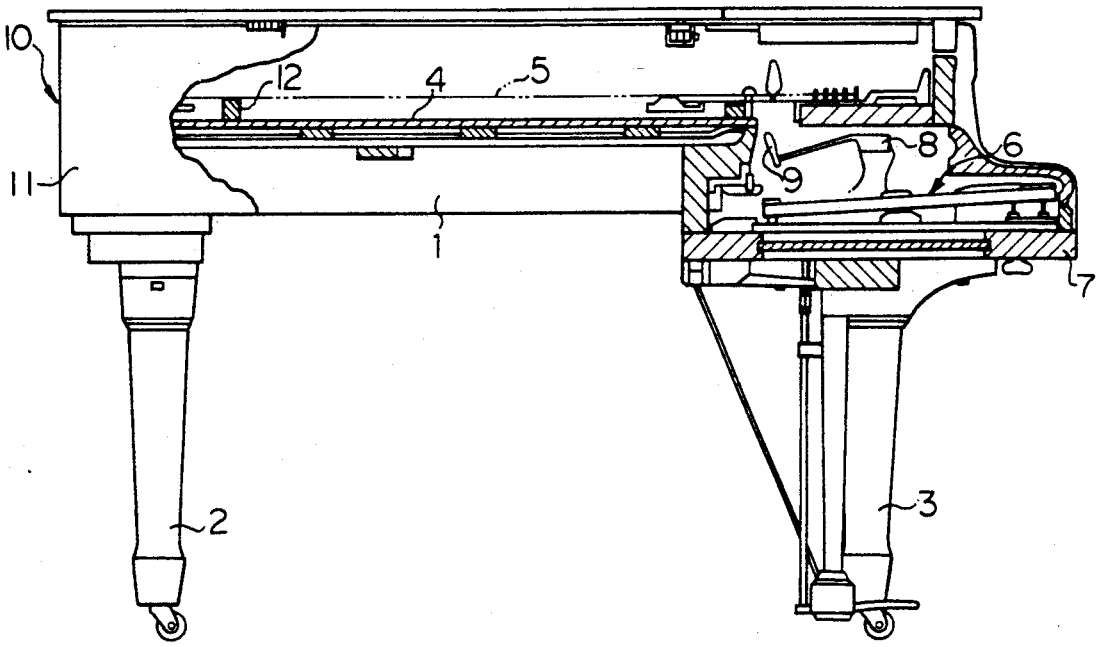
FIG. 1 is a partially cut away side view showing a grand piano with a sound board to which the present invention appertains.

Referring first to FIG. 1 of the drawings, a grand piano comprises a wooden frame 1 supported by legs 2 and 3, a sound board 4 provided on the wooden frame 1, a plurality of strings 5 stretched over the sound board 4, a key board 6 having a plurality of keys and provided on a key bed 7, and a key action mechanism 8 provided in association with the key board 7 for causing hammers 9 to selectively strike the strings 5 in accordance with motions of the keys. The sound board 4 forms in combination a piano case 10 together with a side plate 11, and the strings 5 are pressed onto a bridge 12 anchored to the sound board 4.

When one of the keys are depressed, the key motion is transferred to the associated hammer 9 through the key action mechanism 8, and the hammer 9 strikes one of the strings 5. Upon the strike with the hammer 9, vibrations take place in the string 5, and the vibrations are transferred to the sound board 4. The sound board 4 vibrates and converts the vibrations to an acoustic energy for producing a sound with a note assigned to the key to be depressed. The sound board 4 according to the present invention is reinforced with thread members as described hereinbelow in detail and, therefore, makes the sound soft.

Figure 2:
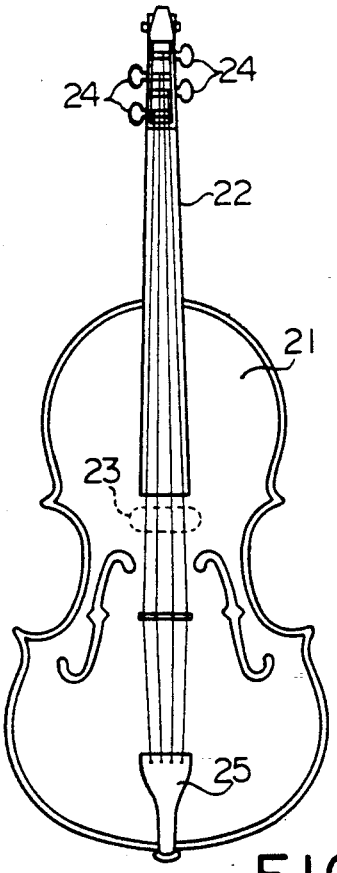
FIG. 2 is a front view showing a violin with a sound board to which the present invention appertains.

Turning to FIG. 2 of the drawings, there is illustrated a violin which comprises a sound board 21, a finger board 22, four strings 23 stretched over the finger board 22 and anchored between pegs 24 and a string holder 25, and the sound board 21 is reinforced with a plurality of wires in a similar manner to the sound board 4 incorporated in the grand piano according to the present invention. Namely, the sound board 21 is formed of wood containing wood fibers substantially oriented in a predetermined direction, and the plurality of wires are bonded to the wood plate in such a manner as to respectively extend in directions substantially parallel to the predetermined direction. The wood plate has a modulus of longitudinal elasticity to a force in the predetermined direction, and each of the wires has a modulus of longitudinal elasticity to a force in the longitudinal direction thereof. The modulus of longitudinal elasticity of each wire is larger than that of the wood plate, and, therefore, the sound board 21 is reinforced against the force in the predetermined direction only. The sound board 21 thus reinforced allows the sound to have a soft tone color. Only two examples of the musical instruments are introduced with reference to the drawings, however, the sound board according to the present invention is applicable to other musical instruments such as, for example, an upright piano, an organ or a guitar.

Description is hereinbelow made on the sound board 4 incorporated in the grand piano in detail.

First Embodiment

Figure 3:
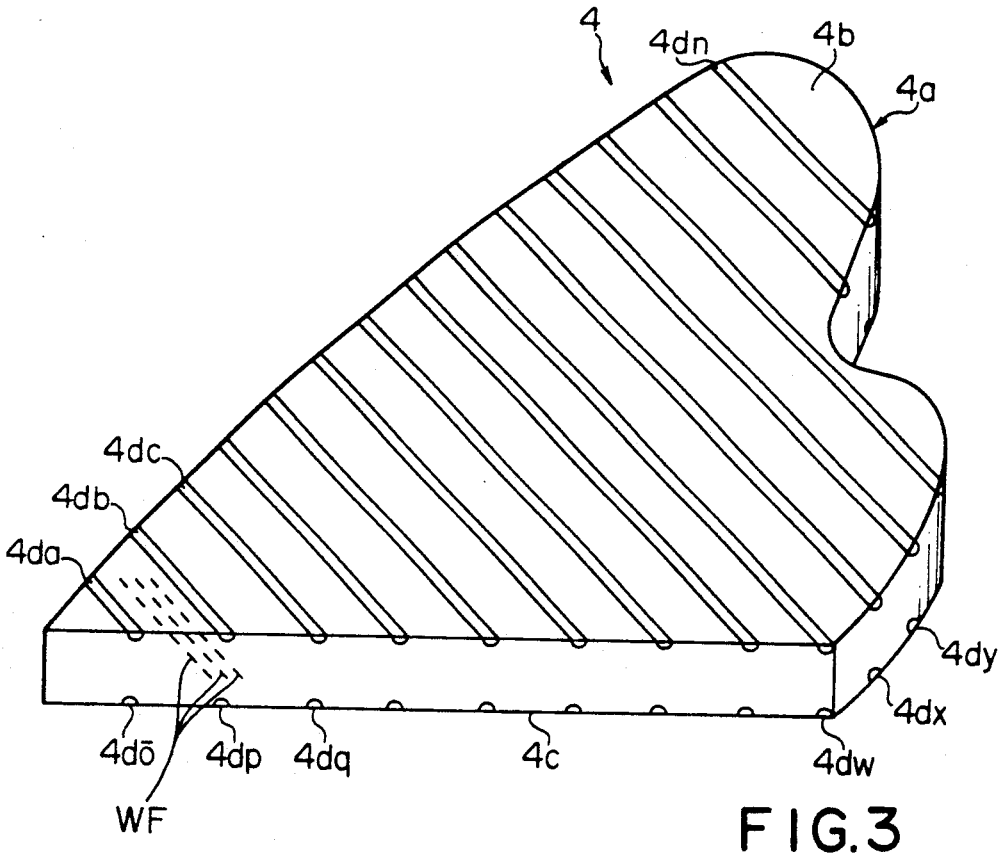
FIG. 3 is a perspective view showing a sound board incorporated in the grand piano shown in FIG. 1.

Referring to FIG. 3 of the drawings, the sound board 4 comprises a wooden plate member 4*a* of a spruce or a maple tree, and the wooden plate member 4*a* has an upper surface 4*b* and a lower surface 4*c* opposite to each other. The strings 5 are stretched over the upper surface 4*b*, and a part of the lower surface 4*c* is faced to the wood frame 1. The wooden plate member 4*a* contains wood fibers WF, and is cut in such a manner that the wood fibers WF are generally oriented from the front side (where the key board 6 is located) of the grand piano to the rear side. The orientation of the wood fibers WF is hereinbelow referred to as "first direction".

A lot of thread members (including thread members 4*da* to 4*dn* and 4*do* to 4*dy*) are embedded in the upper and lower surfaces 4*b* and 4*c*, but are partially exposed to the upper and lower surfaces 4*b* and 4*c*. Although the thread members embedded in the wooden plate member 4*a* are larger in number than the thread members labeled with 4*da* to 4*dn* and 4*do* to 4*dy*, the thread members labeled with the reference marks 4*da* to 4*dy* represent all of the thread members in the following description. The thread members 4*da* to 4*dn* embedded in the upper surface 4*b* are located in correspondence to the thread members 4*do* to 4*dy* embedded in the lower surface 4*c*, respectively, and, accordingly, are arranged in symmetry with the thread members 4*do* to 4*dy*. Each of the thread members 4*da* to 4*dy* is spaced apart from adjacent thread member or members by predetermined or regular spacings.

In this instance, the wooden plate member 4*a* is formed of a spruce or a maple tree and has a first modulus of longitudinal elasticity El1 to a force exerted thereon in the first direction ranging from about 13 GPa to about 15 GPa, and the first modulus of longitudinal elasticity of the wooden plate member 4*a* is too small to achieve good acoustic characteristics. The thread members 4*da* to 4*dy* reinforce the wooden plate member 4*a*, and, accordingly, each of the thread members 4*da* to 4*dy* has a second modulus of longitudinal elasticity El2 much larger than the first modulus of longitudinal elasticity El1. The second modulus of longitudinal elasticity El2 is fallen with a range from about 140 GPa to about 250 GPa, and, for this reason, the thread members 4*da* to 4*dy* are formed of a substance selected from the group consisting of aluminum, copper, various whiskers and various resin wires each reinforced with fibers. A resin such as, for example, an epoxy resin or a polyester resin is permeated into carbon fibers or boron fibers, and the resin is, then, thermally set to produce a thermosetting resin wire reinforced with fibers. It is desirable to carry out the thermo-setting under application of a tension to the fibers permeated with the resin. Any limitation is not set on the size and the cross section of the thread members 4*da* to 4*dy*, however, the diameter of each thread member is desirably fallen within a range from about 0.3 millimeter to about 3 millimeters. In this instance, each of the thread members 4*da* to 4*dy* is generally circular in cross section, but any cross section such as a rectangular cross section may be employed in another implementation.

Each of the thread members 4*da* to 4*dy* is spaced apart from adjacent thread member or members at regular spacings. It is important for determination of the distance between two adjacent thread members to take the followings into account of. First, the thread members 4*da* to 4*dy* increase a first equivalent modulus of longitudinal elasticity of the sound board 4 to a fore exerted in the first direction without increasing a second equivalent modulus of longitudinal elasticity to a force exerted in a perpendicular direction to the first direction. Second, an equivalent specific gravity of the sound board 4 should be less increased because the thread members 4*da* to 4*dy* need to increase a ratio of the first equivalent modulus of longitudinal elasticity to the equivalent specific gravity. Finally, an equivalent modulus of traverse elasticity should be less increased because the thread members 4*da* to 4*dy* need to enlarge a ratio of the first equivalent modulus of longitudinal elasticity to the equivalent modulus of traverse elasticity.

Table 1 shows experimental results for evaluation of the thread members 4*da* to 4*dy*. For producing specimens, a plurality of wooden plate members 4*a* of a spruce are prepared, and each of the wooden plate members 4*a* has the first modulus of longitudinal elasticity El1 of about 14.40 GPa, the first specific gravity of about 0.4 g/cm$^3$ and a thickness of about 10 millimeters. A lot of epoxy resin wires each reinforced with carbon fibers are further prepared as the thread members 4*da* to 4*dy*, and each of the epoxy resin wires are about 0.5 millimeter in diameter and about 240 GPa in the second modulus of longitudinal elasticity El2. A plurality of narrow grooves are formed in the upper and lower surfaces 4*b* and 4*c* at regular spacings of about 9 millimeters, and a set of the thread members 4*da* to 4*dy* are snugly received in the narrow grooves of the flat upper and lower surfaces 4*b* and 4*c* together with adhesive compound of an epoxy resin capable of setting at room temperature. The thread members 4*da* to 4*dy* are pressed with roller so as to be embedded into the wooden plate member 4*a*. The sound board thus produced is labeled as "specimen 1" in Table 1.

Other specimens 2, 3 and 4 are arranged at respective regular spacings of about 5.5 millimeters, about 4 millimeters and about 3 millimeters, and a prior art sound board is further fabricated without any thread member for comparison usage.

As described hereinbefore, the thread members range from about 0.3 millimeter to about 3 millimeters in diameter, and, accordingly, the narrow grooves are about 0.3 millimeter to about 3 millimeters in depth. Therefore, the words "major surface" means a surface portion of the wooden plate member measuring from about 0.3 millimeter to about 3 millimeters in depth.

TABLE 1

| | | specimens | | | |
|---|---|---|---|---|---|
| | prior art | 1 | 2 | 3 | 4 |
| spacings: | none | 9 mm | 5.5 mm | 4 mm | 3 mm |
| EE1 (GPa): | 14.40 | 15.08 | 16.72 | 18.90 | 20.54 |
| EE1/G: | 18.4 | 19.2 | 21.4 | 24.2 | 26.2 |
| SG (g/cm$^3$): | 0.4 | 0.405 | 0.41 | 0.418 | 0.424 |
| EEL/SG: | 36.0 | 37.23 | 40.78 | 45.22 | 48.44 |
| acoustic characteristics: | not good | good | good | good | good |

In Table 1, EEl stands for the first equivalent modulus of longitudinal elasticity of the sound board to a force parallel to the first direction, G is representative of the equivalent modulus of traverse elasticity, and SG is an abbreviation of "specific gravity".

As will be understood from Table 1, the equivalent modulus of longitudinal elasticity as well as the specific gravity of the sound board are increased by decreasing the regular spacings from 9 millimeters to 3 millimeters. However, the ratio of EEl to SG is enlarged in value in spite of the increase of SG, and good acoustic characteristics are achieved by the sound boards according to the present invention.

The thread members 4*da* to 4*dy* are embedded into the upper and lower surfaces 4*b* and 4*c* through the following process sequence. The process sequence starts with formation of narrow grooves in the upper and lower surface portions 4*b* and 4*c* in parallel to one another. The depth and the width of each narrow groove depend on the cross section of the thread member inserted therein. An adhesive compound is applied to the inner surfaces respectively defining the narrow grooves, and the thread members 4*da* to 4*dy* are snugly received into the narrow grooves, respectively. The adhesive compound is of a synthetic resin such as a resorcinol resin, an epoxy resin or an urethane resin, but is much smaller in elasticity than the wooden plate member 4*a* and each of the thread members 4*da* to 4*dy*, and, for this reason, the thinner the adhesive compound film, the much desirable for the sound board 4. The process sequence achieves a large adhesion between the wooden plate member 4*a* and the thread members 4*da* to 4*dy* because of a large amount of adhesive area, and the finished upper and lower surfaces 4*b* and 4*c* are relatively smooth because most of each thread member is embedded in the wooden plate member 4*a*.

However, another sound board according to the present invention may be fabricated through the second process sequence. The second process sequence starts with application of an adhesive compound in lines on the upper and lower surfaces thereof at regular spacings without any groove. The thread members 4*da* to 4*dy* are placed on the lines of the adhesive compound, respectively, and the thread members 4*da* to 4*dy* are subjected to heat under pressure. Then, the adhesive compound is set for bonding the thread members 4*da* to 4*dy* to the upper and lower surfaces 4*b* and 4*c*. The second process sequence is simple and, accordingly, easy for fabrication because of no formation stage of grooves.

Still another sound board may be fabricated through the third process sequence. The third process sequence starts with preparation of prepreg fibers which is produced by permeating one of aforementioned liquid resin into fibers followed by semi-setting. The prepreg fibers are placed on the upper and lower surfaces in a predetermined pattern, and heat is applied to the prepreg fibers under pressure for thermo-setting. The third process sequence is also simple and easy for fabrication. If a tension is exerted on each of the prepreg fibers on the upper and lower surfaces before and in the thermo-setting stage, the acoustic characteristics of the sound board are further improved.

Second Embodiment

Figure 4:
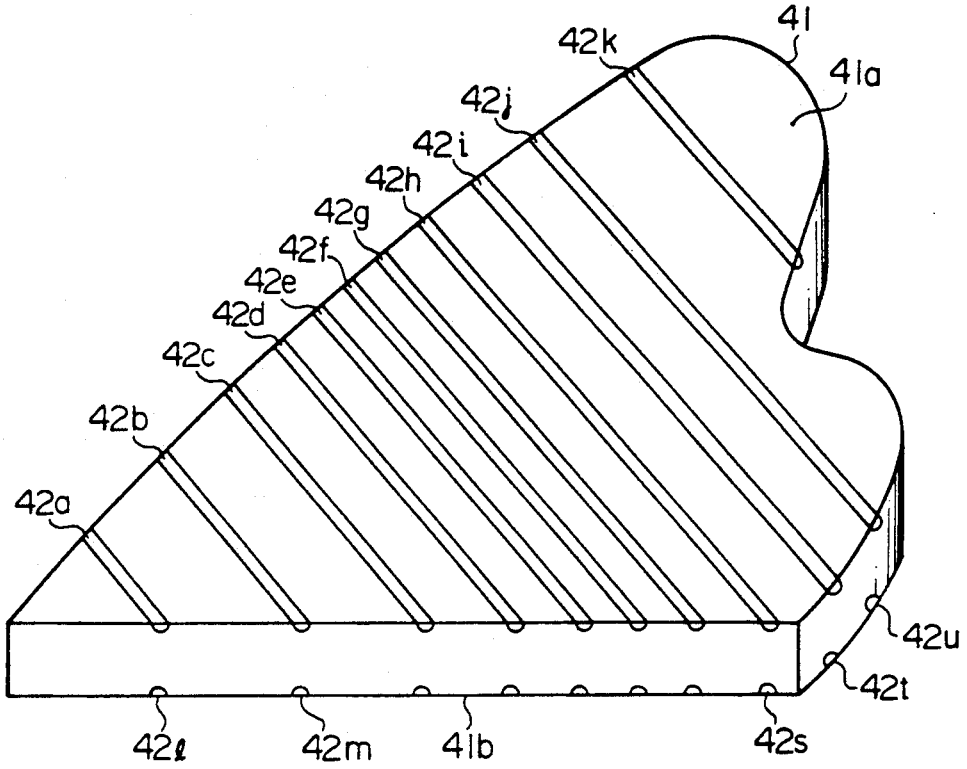
FIG. 4 is a perspective view showing another sound board replaceable with the sound board shown in FIG. 3.

Turning to FIG. 4 of the drawings, there is shown another sound board embodying the present invention. The sound board is replaceable with the sound board shown in FIG. 3 and comprises a wooden plate member 41 having an upper surface 41*a* and a lower surface 41*b*. A plurality of thread members 42*a* to 42*u* are embedded in the upper and lower surfaces 41*a* and 41*b* at irregular spacings. Namely, the minimum spacing between the thread members 42*e* and 42*f* in the central area of the upper surface 41*a* is of the order of 3 millimeters, but the maximum spacing between the thread members 42*a* and 42*b* or 42*j* and 42*k* on either side area is about 30 millimeters. The spacing is gradually increased from the central area toward the side areas of the upper surface 41*a*. The thread members 42*a* to 42*k* is arranged in symmetry with the thread members 42*l* to 42*u*. Other features such as the substance of the thread members 42*a* to 42*u* of the sound board shown in FIG. 4 is similar to those of the sound board shown in FIG. 3, and, for this reason, no detailed description is incorporated for the sake of simplicity.

The acoustic characteristics of the sound board shown in FIG. 4 are measured and better than the sound boards of the present invention listed in the Table 1.

As will be understood from the foregoing description, the sound board according to the present invention is reinforced with the plurality of thread members arranged in the first direction and larger in modulus of longitudinal elasticity to a force in the first direction than the wooden plate member, and, therefore, is excellent at acoustic characteristics such as, for example, attenuation ratio in radiation of sound. In detail, the sound board according to the present invention is large enough in EEl/SG to produce a loud sound with a good spread. Moreover, The equivalent modulus of longitudinal elasticity EEl is drastically increased in maintaining the equivalent modulus of traverse elasticity G, and the large ratio of EEl to G results in a soft deep sound due to the attenuation of high order harmonic tones of the sound without sacrifice of middle and low order harmonic tones.

Figure 5:
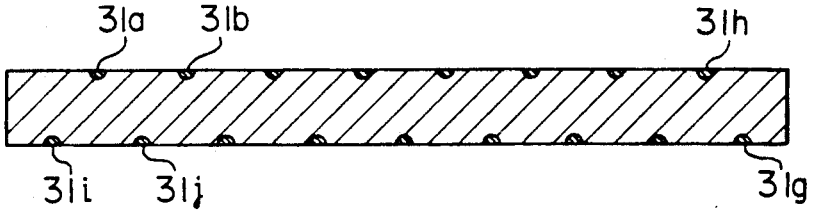
FIG. 5 is a cross sectional view showing a modification of the first embodiment shown in FIG. 3.

Although particular embodiments of the present invention have been shown and described, it will be obvious to those skilled in the art that various changes and modifications may be made without departing from the spirit and scope of the present invention. For example, the thread members 4*da* to 4*dy* are embedded in both surfaces of the wooden plate member 4*a*, however, the thread members may be embedded into one of the upper and lower surfaces of the wooden plate member 4*a* in another implementation. Moreover, the thread members 4*da* to 4*dn* of the first embodiment is located in correspondence to the thread members 4*do* to 4*dy*, respectively, however, each of the thread members 31*a* to 31*h* in the upper surface 4*b* may be laterally shifted from the corresponding position so that each pair of thread members such as 31*a* and 31*i* are arranged in a staggered manner as shown in FIG. 5. The thread members are exposed to the upper and lower surfaces of the sound boards shown in FIGS. 3 to 5, however, a finishing plate with a smooth surface may be attached onto the thread members and the finishing plate not only covers the thread members but also further reinforces without any deterioration of acoustic characteristics of the sound board.

What is claimed is:

1. A sound board incorporated in a musical instrument comprising a) a wooden plate member containing wood fibers substantially oriented to a first direction, said wooden plate member having a first modulus of longitudinal elasticity to a force exerted thereto in a direction substantially parallel to said first direction, and b) a plurality of thread members fixed to at least one major surface of said wooden plate member at spacings and extending in directions substantially parallel to said first direction, each of said thread members having a second modulus of longitudinal elasticity larger than said first modulus of longitudinal elasticity.

2. A sound board as set forth in claim 1, in which each of said thread members has a ratio of said second modulus of longitudinal elasticity to a second specific gravity thereof larger in value than a ratio of said first modulus of longitudinal elasticity to a first specific gravity thereof.

3. A sound board as set forth in claim 2, in which said thread members are embedded in said at least one major surface.

4. A sound board as set forth in claim 2, in which said thread members are spaced apart from one another at regular spacings.

5. A sound board as set forth in claim 4, in which each of said regular spacings ranges from about 3 millimeters to about 9 millimeters.

6. A sound board as set forth in claim 4, in which said wooden plate member further has another surface opposite to said major surface and in which other thread members are embedded in said another surface extending in parallel to said first direction at spacings.

7. A sound board as set forth in claim 6, in which said thread members in said major surface and said thread members in said another surface are arranged in symmetry with one another.

8. A sound board as set forth in claim 6, in which said thread members in said major surface are respectively paired with said thread members in said another surface and in which said thread members of each pair are arranged in a staggered manner.

9. A sound board as set forth in claim 2, in which said thread members are spaced apart from one another at irregular spacings.

10. A sound board as set forth in claim 9, in which said major surface has a central area between side areas and in which said thread members in said central area are spaced apart a distance smaller than that between said thread members in said side areas.

11. A sound board as set forth in claim 10, in which said wooden plate member further has another surface opposite to said major surface and in which other thread members are fixed to said another surface extending in parallel to said first direction at said irregular spacings.

12. A sound board as set forth in claim 11, in which said thread members in said major surface and said thread members in said another surface are arranged in symmetry with one another.

13. A sound board as set forth in claim 2, in which said thread members are formed of a substance selected from the group consisting of aluminum, copper, whiskers and a resin strip reinforced with fibers.

14. A sound board as set forth in claim 13, in which said resin strip contains thermo-setting resin permeated into either carbon or boron fibers and in which said wooden plate member is formed of either spruce or maple tree.

15. A grand piano comprising a) a frame supported by legs, b) a sound board provided on said frame, c) a plurality of strings stretched over said sound board, d) a key board having a plurality of keys and provided on a key bed which in turn is supported by said legs, and e) a key action mechanism provided in association with said key board and operative to cause hammer members to selectively strike said strings in accordance with motions of said keys, in which said sound board comprises b-1) a wooden plate member containing wood fibers substantially oriented to a first direction, said wooden plate member having a first modulus of longitudinal elasticity to a force exerted thereto in a direction substantially parallel to said first direction, and b-2) a plurality of thread members fixed to at least one major surface of said wooden plate member at spacings and extending in directions substantially parallel to said first direction, each of said thread members having a second modulus of longitudinal elasticity larger than said first modulus of longitudinal elasticity.

* * * * *